US005217145A

United States Patent [19]

Haan et al.

[11] Patent Number: 5,217,145

[45] Date of Patent: Jun. 8, 1993

[54] MULTIPLE PRODUCT DISPENSER

[75] Inventors: Richard J. Haan, Raleigh, N.C.; Michael G. Maietta, Cogan Station, Pa.

[73] Assignee: Glaxo Inc., Research Triangle Park, N.C.

[21] Appl. No.: 937,965

[22] Filed: Aug. 28, 1992

[51] Int. Cl.[5] ..... B67D 5/56

[52] U.S. Cl. ..... 222/129; 222/135; 222/390

[58] Field of Search ..... 222/129, 135, 145, 390, 222/548, 387; 206/219; 401/175

[56] References Cited

U.S. PATENT DOCUMENTS

| | | | |
|---|---|---|---|
| 3,013,697 | 12/1961 | Gill | 222/390 X |
| 3,082,914 | 3/1963 | Gill | 222/390 X |
| 4,046,288 | 9/1977 | Bergman | 222/135 |
| 5,174,475 | 12/1992 | Day et al. | 222/135 X |

*Primary Examiner*—Gregory L. Huson
*Attorney, Agent, or Firm*—Richard E. Jenkins

[57] ABSTRACT

A multiple product dispenser for sequential dispensing of a first product in substantially its entirety and then a second product immediately thereafter from a dispenser by continuously rotating a thumb wheel at the bottom of the dispenser housing.

15 Claims, 3 Drawing Sheets

MULTIPLE PRODUCT DISPENSER

TECHNICAL FIELD

The present invention relates to product dispensers and more particularly to a multiple product dispenser which sequentially provides a first product followed by a second product.

RELATED ART

As can be appreciated with reference to U.S. patent application Ser. No. 07/675,207 filed Mar. 26, 1991 now U.S. Pat. No. 5,174,475 for "Sequential Dosing of Anti-Fungal and Anti-Inflammatory Compositions", which is commonly owned by the assignee of the present invention, it is highly desirable to dispense a topical medicant by multiple dosing wherein a first composition is dispensed followed by the dispensing of a second and different composition. For example, the aforementioned application discloses dispensing a first composition having both an anti-fungal and an anti-inflammatory agent which is followed by the dispensing of a second composition having only an anti-fungal as the active ingredient (wherein the anti-fungal is oxiconazole and the anti-inflammatory agent is fluticasone). Most suitably the first and second pharmaceutical compositions are in the form of creams, ointments and/or lotions for most effective delivery from a dispenser.

The aforementioned application further discloses several embodiments of proposed dispensers suitable for the sequential dosing of the proposed topical medicant consisting of the anti-fungal and anti-inflammatory first composition and the anti-fungal second composition. Specifically, FIG. 1 of the drawings shows a tube having separated first and second compartments for holding creams or ointments of the first and second compositions, respectively. The compositions may be selectively dispensed from the tube by removing the screw-on cap provided for each compartment at opposing ends of the tube.

Another multiple dosing dispenser is shown in FIG. 2 of the drawings which depicts a dual syringe dispenser provided with two cylinders each having a corresponding plunger provided therein. The two compositions in the cylinders may be dispensed by applying selective pressure on the corresponding plungers after removing the screw-on caps at the opposing ends of the cylinders. FIG. 2A depicts a slightly different dispenser wherein a single passageway is provided at the top thereof which may be selectively rotated into communication with either cylinder when dispensing of the composition therein is desired. Such a configuration for the dispenser prevents unintentional and simultaneous dispensing of both compositions contained within the dual cylinders.

FIG. 3 of the patent drawings of application Ser. No. 07/675,207 illustrates still another embodiment of a multiple dosing sequential dispenser comprising a single cylinder containing both first and second pharmaceutical compositions therein. Actuation of the single plunger results in dispensing of the first composition through the nozzle, and continued movement of both compositions of the cylinder toward the nozzle after repeated dispensing serves to dislodge a diaphragm which initially serves to physically separate the two compositions. Thus, when nearly all of the first composition has been dispensed, the diaphragm is pierced by a depending sharp element at the top of the dispenser so that subsequent use will cause the second composition to be dispensed.

Another embodiment of this type of dispenser is disclosed in FIG. 4 of the drawings which depicts a dual bladder dispenser comprising two bladders within a tube which are joined at the top for dispensing through a singular nozzle. The bladders are each filled with a different composition at the top and bottom thereof so that as a key is turned the tube will dispense sequentially a first pharmaceutical composition which is then followed by a different pharmaceutical composition without the patient recognizing the changeover and without the patient being required to be reminded of the need to do so.

Although the various embodiments of a multiple dosing dispenser disclosed in Ser. No. 07/675,207 filed Mar. 26, 1991 and owned by the Assignee of the present invention all are intended to effect a multiple sequential dosage of a topical medicant comprising a first pharmaceutical composition containing an effective amount of an anti-fungal agent and anti-inflammatory agent and a second pharmaceutical composition consisting essentially of an effective amount of an anti-fungal agent, the multiple dosage dispensers disclosed therein do not possess the efficacy of the multiple dosage sequential dispenser of the present invention which is described in detail hereinbelow and which would serve to dispense the aforementioned two pharmacological compositions as well as many other types of products.

DISCLOSURE OF THE INVENTION

In accordance with the present invention, applicants provide a multiple product dispenser adapted to dispense a first product and then to dispense a second product thereafter. The dispenser is formed of a housing comprising a body portion and a closure member defining an outlet at the top end thereof. An elongate actuator element is rotatably mounted in the bottom body portion of the housing and extends upwardly therefrom with the top end terminating short of the closure member. A first plunger element is mounted on the lower portion of the actuator element and is adapted to move from a lowermost first position to an elevated second position closer to the closure member. A second plunger element is removably mounted on the top end of the actuator element so as to define a first product chamber between the second plunger element and the top body portion of the housing and a second product chamber between the first plunger element and the second plunger element. The second plunger element is adapted to be urged by a product in the second product chamber from a lowermost first position on said actuator element to an elevated second position closer to the closure member and detached from the actuator element when the first plunger element is actuated by rotatable movement of the actuator element.

Thus, rotatable movement of the actuator element serves to force a product in the first product chamber through the outlet of the housing closure member and subsequent rotatable movement serves to force a product in the second product chamber through said elevated second plunger element and in turn through the outlet of said closure member.

It is therefore the object of the present invention to provide a multiple product dispenser for sequentially dispensing a first product and then dispensing a second product thereafter.

It is another object of the present invention to provide a multiple product dispenser for sequentially dispensing a first pharmacological product and then dispensing a second pharmacological product thereafter.

It is still another object of the present invention to provide a multiple product dispenser for sequentially dispensing a first pharmacological product immediately followed by a second pharmacological product wherein the sequential dispensing is accomplished automatically without the user having to either recognize or actively select between the first and second pharmacological products.

It is still another object of the present invention to provide a multiple product dispenser that dispenses a first pharmacological product in its entirety followed immediately by dispensing of the second pharmacological product.

It is yet another object of the present invention to provide a multiple product dispenser for dispensing a combo dermatological product consisting of an anti-fungal and an anti-inflammatory agent followed by a second pharmacological product consisting of a maintenance product.

Some of the objects of the invention having been stated, other object will become evident as the description proceeds, when taken in connection with the accompanying drawings described below.

BEST MODE FOR CARRYING OUT THE INVENTION

Figure 1:
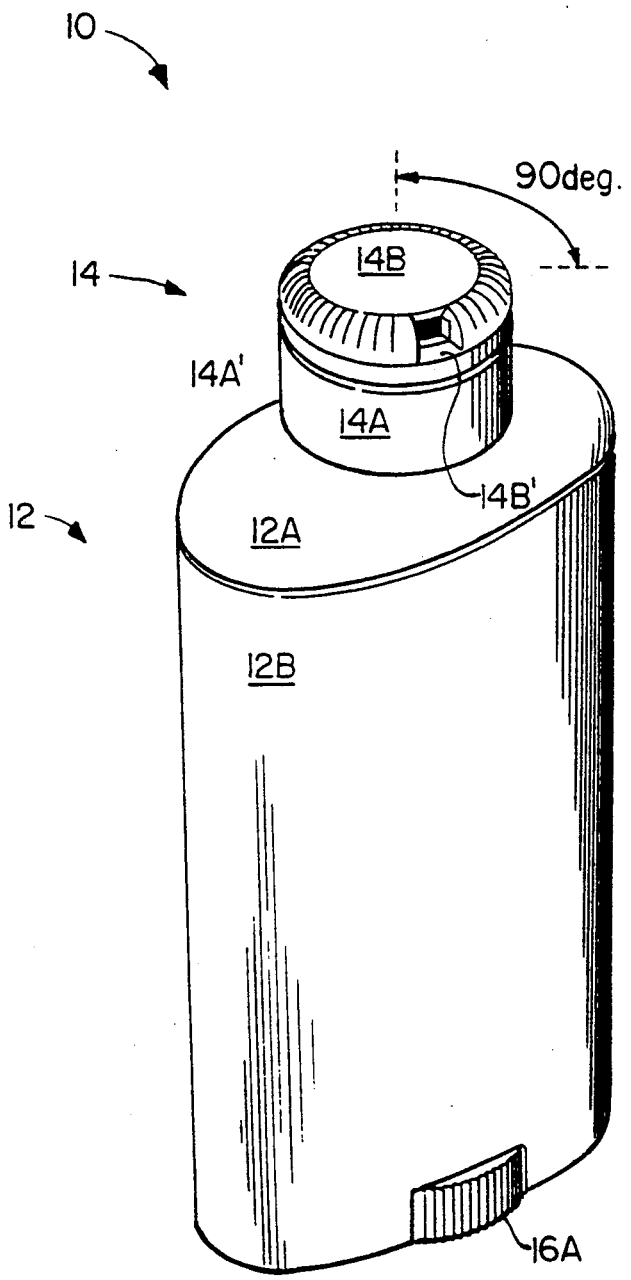
FIG. 1 is a perspective view of the multiple product dispenser of the present invention.
Figure 2:
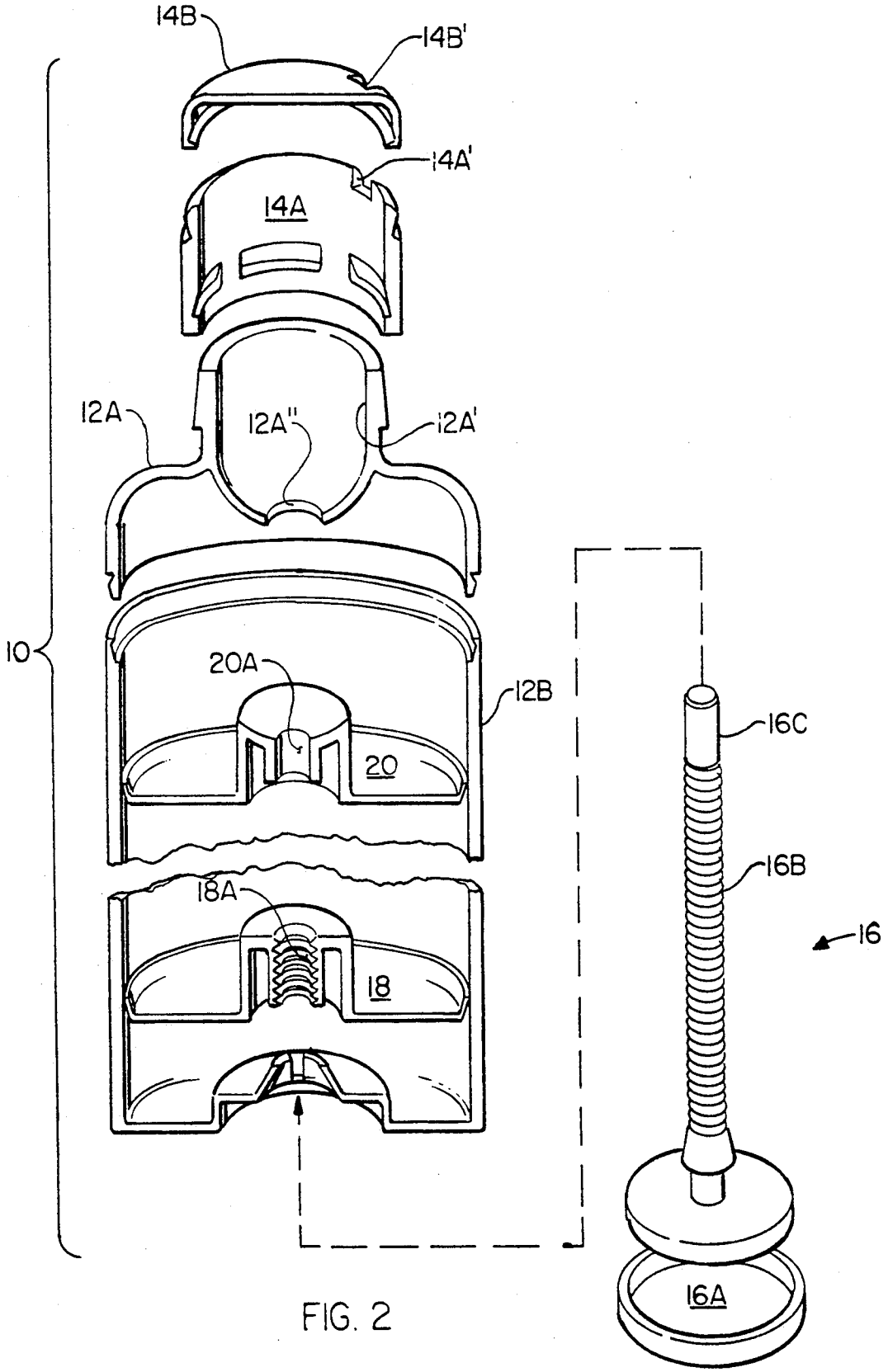
FIG. 2 is an exploded vertical cross-sectional view, with parts broken away for clarity, of the multiple product dispenser shown in FIG. 1.

Referring now to FIGS. 1-3 of the drawings applicants' multiple product dispenser is generally designated as 10 therein. Dispenser 10 comprises body 12 and dispensing cap 14. A screw post 16 is rotatably mounted in the bottom of body 12 (see particularly FIG. 2) and is provided with thumb wheel 16A at the lower end thereof to impart rotatably movement thereto. Screw post 16 defines a threaded portion 16B along the length of the lower and medial portions thereof and a non-threaded, sleeve-like portion 16C at the top end thereof (see particularly FIG. 2).

Referring again to FIG. 2 and FIGS. 3A-3C, it can be seen that a lower plunger 18 having internally threaded aperture 18A therein threadably engages screw post 16 at the bottom thereof. An upper plunger 20 which is provided with a non-threaded aperture 20A therein is removably mounted to non-threaded portion 16C of screw post 16. In this fashion, lower plunger 18 and upper plunger 20 which sealingly abut body 12 of dispenser 10 serve to define two chambers therein. A first chamber A (see FIGS. 3A-3C) is defined between upper plunger 20 and the top of housing body 12 and second chamber B is defined between lower plunger 18 and upper plunger 20. Dispenser 10 is intended to be used by containing a first product in chamber A and a second product in chamber B which will be sequentially dispensed in a fashion which will be described in detail hereinafter.

Also of note, and with particular reference to FIG. 2, it can be seen that a preferred construction of dispenser 10 provides for a two piece body 12 consisting of upper body section 12A and lower body section 12B which are suitably affixed together by snap-fit, continuous thread or other conventional manner. Upper body section 12A defines a neck portion 12A' which is open at the top thereof and fluidly communicates with chambers A and B through central aperture 12A" in the substantially closed bottom end thereof.

Dispensing cap 14 is formed from a stationary section 14A which, most suitably, snap-fits over body neck portion 12A' and a rotating closure top section 14B. A suitable opening 14A' is provided at the top of stationary section 14A which corresponds with an opening 14B' in closure top section 14B, and opening 14B' can be rotated into registration with opening 14A' by suitable rotatable movement of closure top section 14B. The construction of dispensing cap 14 is a matter of design choice, but it is presently contemplated that a 90° rotation of closure top section 14B relative to stationary section 14A is to be preferred for opening and closing dispenser 10 by placing openings 14A' and 14B' into registration and out of registration, respectively.

Although dispenser 10 can be formed from any suitably material, applicants presently prefer that the dispenser and components thereof be formed from virgin polypropylene. Also, although not shown in the drawings, it is contemplated that a ratchet mechanism could be provided in operative association with thumb wheel 16A to prevent reverse rotation thereof any more than about one-quarter turn to assure proper operation of the dispensing mechanism of dispenser 10.

Figures 3A, 3B, 3C:
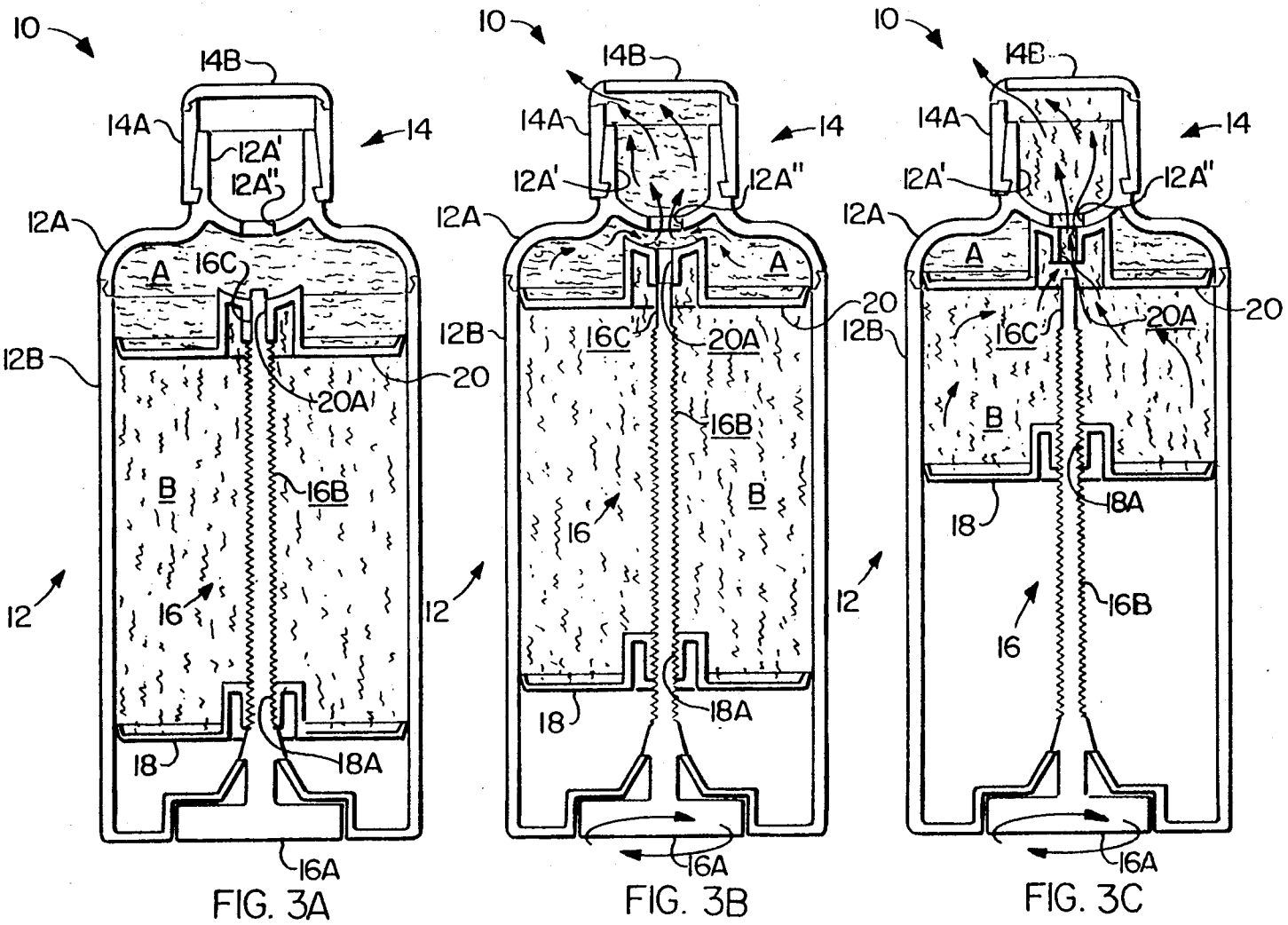
FIGS. 3A-3C illustrate vertical cross-sectional views of the multiple product dispenser shown in FIG. 1 prior to use, dispensing the first product, and dispensing the second product, respectively.

In use, and with reference to FIGS. 3A-3C, closed dispenser 10 (FIG. 3A) would first be opened by manipulating dispensing cap 14 so as to place opening 14B' of closure top section 14B into registration with opening 14A' of stationary section 14A. Next, thumb wheel 16A is rotated so as to move lower plunger 18 upwardly on screw post 16 (see FIG. 3B). Lower plunger 18 moves upwardly and serves to compress the product in chamber B which serves to force upper plunger 20 upwardly which in turn compresses the product in chamber A. In this fashion, the product in chamber A will be forced through aperture 12A" into neck portion 12A' and in turn through apertures 14A' and 14B' to the exterior of dispensing cap 14.

As upper plunger 20 moves upwardly so as to dispense the product in chamber A substantially in its entirety from dispenser 10, upper plunger 20 will snugly nest in the upper section of housing body 12 (see FIG. 3C) where central aperture 20A thereof is now open since upper plunger 20 has slidably moved up non-threaded portion 16C of screw post 16 and become vertically spaced-apart therefrom so as to provide a fluid outlet for the product contained in chamber B. Thus, continued rotation of thumb wheel 16A will now drive lower plunger 18 upwardly so as to force all of the product in chamber B through aperture 20A of upper plunger 20 and in turn through aperture 12A" in neck portion 12A' and in turn out of dispensing cap 14 in the manner previously described herein.

Summarily, it can be appreciated that two different pharmacological products can be sequentially dispensed by multiple product dispenser 10 in a fashion whereby the patient cannot misuse either product and, in fact, is prevented from participating in the dispensing of the two different products in any fashion other than rotation of thumb wheel 16A at predetermined intervals.

Although applicants contemplate that multiple product dispenser 10 of the present invention can be used to sequentially dispense substantially any type of pharmacological as well as non-pharmacological products, a particularly suitable application is presently believed to be to dispense a first pharmacological "combo product" for treatment of patients with certain dermatological problems which consists of OXISTAT (manufactured by Glaxo Inc. of Research Triangle Park, North Carolina) and fluticasone anti-inflammatory and anti-fungal agents, respectively. This "combo product" serves to address a very broad spectrum of dermatological end uses but could possibly be misused if applied alone. However, the safety feature provided by the present invention is the subsequent dispensing of a maintenance second product such as OXISTAT. In this fashion, multiple product dispenser 10 can be used to first dispense a "combo product" in its entirety and immediately thereafter a maintenance product so as to provide a safe and fool-proof dermatological topical therapy.

It will be understood that various details of the invention may be changed without departing from the scope of the invention. Furthermore, the foregoing description is for the purpose of illustration only, and not the purpose of limitation—the invention being defined by the claims.

What is claimed is:

1. A dispenser adapted to dispense a first product and then to dispense a second product thereafter, said dispenser comprising:

a housing comprising a body portion and having a closure member defining an outlet at the top end thereof;

an elongate actuator element rotatably mounted in the bottom body portion of said housing and extending upwardly therefrom with the top end thereof terminating short of said closure member;

a first plunger element mounted on the lower portion of said actuator element and adapted to move from a lowermost first position to an elevated second position closer to said closure member; and a second plunger element removably mounted on the top end of said actuator element so as to define a first product chamber between said second plunger element and the to body portion of said housing and a second product chamber between said first plunger element and said second plunger element, said second plunger element being adapted to be urged by a product in said second product chamber from a lowermost first position on said actuator element to an elevated second position (1) closer to said closure member and (2) detached from said actuator element when said first plunger element is actuated by rotatable movement of said actuator element;

whereby rotatable movement of said actuator element serves to first force a product in said first product chamber through the outlet of said housing closure member and subsequent rotatable movement serves to force a product in said second product chamber through said elevated second plunger element and thereafter through the outlet of said closure member.

2. A dispenser according to claim 1 wherein the body portion of said housing comprises lower body and upper body sections affixed together.

3. A dispenser according to claim 2 wherein said lower body and upper body sections are snap-fit together.

4. A dispenser according to claim 1 wherein said closure member comprises a stationary lower section defining an aperture therein and an upper section rotatably mounted thereon defining a corresponding aperture therein.

5. A dispenser according to claim 1 wherein said elongate actuator element comprises an elongated screw element having a thumb wheel at the bottom end thereof and an unthreaded portion at the top end thereof for removably receiving said second plunger element.

6. A dispenser according to claim 5 wherein said first plunger element defines an internally threaded aperture therethrough for threadingly engaging said actuator element and said first plunger element sealingly abuts the interior of the body portion of said housing.

7. A dispenser according to claim 5 wherein said second plunger element defines a non-threaded aperture therethrough for removably receiving the unthreaded top portion of said actuator element therein and said second plunger element sealingly abuts the interior of the body portion of said housing, said second plunger element further being adapted to nest in the uppermost part of the body portion of said housing when urged into its elevated second position and to thereby allow a product in said second product chamber to be forced through the empty aperture thereof by said first plunger element.

8. A dispenser according to claim 1 wherein said dispenser is constructed of polypropylene.

9. A dispenser adapted to dispense a first product and then to dispense a second product thereafter, said dispenser comprising:

a housing comprising a body portion and having a closure member defining an outlet at the top end thereof;

an elongate actuator element rotatably mounted in the bottom body portion of said housing and extending upwardly therefrom with the top end thereof terminating short of s id closure member, said actuator element comprising an elongated screw element having a thumb wheel at the bottom end thereof and an unthreaded portion at the top end thereof;

a first plunger element defining an internally threaded aperture therethrough for threadingly engaging the lower portion of said actuator element and adapted to be moved from a lowermost first position to an elevated second position closer to said closure member; and a second plunger element defining a non-threaded aperture therethrough for removably receiving the unthreaded top portion of said actuator element and defining a first product chamber between said second plunger element and the top body portion of said housing and a second product chamber between said first plunger element and said second plunger element, said second plunger element being adapted to be urged by a product in said second product chamber from a lowermost first position on said actuator element to an elevated second position (1) closer to said closure member and (2) detached from said actuator element so a to thereby allow the product in said second product chamber to be forced through the empty aperture thereof when said first plunger element is actuated by rotatable movement of said actuator element; whereby rotatable movement of said actuator element serves to first force a product in said first product chamber through the outlet of said housing closure member and subsequent rotatable movement serves to force a product in said second product chamber through said elevated second plunger element and thereafter through the outlet of said closure member.

10. A dispenser according to claim 9 wherein the body portion of said housing comprises lower body and upper body sections affixed together.

11. A dispenser according to claim 10 wherein said lower body and upper body sections are snap-fit together.

12. A dispenser according to claim 9 wherein said closure member comprises a stationary lower section defining an aperture therein and an upper section rotatably mounted thereon defining a corresponding aperture therein.

13. A dispenser according to claim 9 wherein said first plunger element sealingly abuts the interior of the body portion of said housing.

14. A dispenser according to claim 9 wherein said second plunger element sealingly abuts the interior of the body portion of said housing and is adapted to nest in the uppermost part of the body portion of said housing when urged into its elevated second position.

15. A dispenser according to claim 9 wherein said dispenser is constructed of polypropylene.

* * * * *